United States Patent [19]

Tsumura et al.

[11] Patent Number: 4,991,520

[45] Date of Patent: Feb. 12, 1991

[54] IGNITION BURNER APPARATUS FOR PULVERIZED COAL

[75] Inventors: Toshikazu Tsumura; Ryuichi Sugita; Yasuhide Sakaguchi; Ikuhisa Hamada; Akira Baba, all of Kure, Japan

[73] Assignee: Babcock-Hitachi Kabushiki Kaisha, Tokyo, Japan

[21] Appl. No.: 417,464

[22] Filed: Oct. 5, 1989

Related U.S. Application Data

[63] Continuation of Ser. No. 207,640, May 31, 1988, abandoned.

[30] Foreign Application Priority Data

Oct. 1, 1986 [JP] Japan ..... 61-231107

[51] Int. Cl.[5] ..... F23D 1/00

[52] U.S. Cl. ..... 110/263; 110/185; 110/264; 110/347

[58] Field of Search ..... 110/263, 264, 347, 185

[56] References Cited

U.S. PATENT DOCUMENTS 2,096,945 10/1937 Van Law ..... 110/264
4,223,615 9/1980 Breen et al. ..... 110/264
4,228,747 10/1980 Smirlock et al. ..... 110/347
4,241,673 12/1980 Smith et al. ..... 110/264 X
4,333,405 6/1982 Michaelfelder et al. ..... 110/264
4,412,810 11/1983 Izuma et al. ..... 110/261 X
4,545,307 10/1985 Morita et al. ..... 110/264
4,602,575 7/1986 Grethe ..... 110/264 X

*Primary Examiner*—Edward G. Favors
*Attorney, Agent, or Firm*—Antonelli, Terry, Stout & Kraus

[57] ABSTRACT

The present invention relates to a pulverized coal ignition burner apparatus for use with a pulverized coal boiler or the like for a thermal power plant. The apparatus is so constructed that the pulverized coal is directly burned without generation of a large amount of NOx and without using auxiliary fuel such as light oil, heavy oil and gas that are needed in the conventional apparatus. In the pulverized coal burner apparatus, an ignition region (39) in which a density of the pulverized coal of the mixture of the air and the pulverized coal supplied from a pulverized coal supply source (18) to a pulverized coal burner (4 to 9) by means of a delivery system (23, 50) is enhanced and the flow rate of the mixture flow is low is formed within the pulverized coal burner. The pulverized coal within this region is ignited by an igniter (41).

3 Claims, 4 Drawing Sheets

IGNITION BURNER APPARATUS FOR PULVERIZED COAL

This application is a continuation of application Ser. No. 207,640, filed on May 31, 1988 now abandoned.

TECHNICAL FIELD

The present invention relates to an ignition burner apparatus for pulverized coal, and more particularly to an ignition burner apparatus for directly igniting pulverized coal.

BACKGROUND ART

Recently, in this country there has been a tendency to reduce dependency on petroleum in view of the insufficiency of the supply of crude oil, by changing crude oil burning industrial plants to coal burning plants. In particular, with industrial thermal power generation boilers, large capacity thermal power plants especially for coal are now under construction.

On the other hand, it is a feature of recent electric power demand that a difference in load between a maximum load and a minimum load is increased with the increase of the atomic power generation. There is a tendency that boilers for thermal power generation are modified from those for base loads to load adjustment type boilers. It is possible to enhance the power generation efficiency by several percent under a partial load operation, by a variable pressure operation boiler which operates in a super critical pressure region in a so-called full load operation mode in which the thermal power generation boilers are operated by changing pressures in response to the load and which operates in a subcritical pressure region in a partial load operation mode.

For that reason, there is a decreased number of boilers especially for burning coal, which are always operated under the full load. The boilers designed especially for burning coal are converted to boilers for intermediate loads, which perform a so-called daily start/stop (hereinafter simply referred to as DSS) operational mode in which in the daytime the load is changed among 75% load, 50% load and 25% load and in the night-time the operation is stopped.

Also, there are a small number of the coal burning boilers for performing the DSS operational mode, which operate over the full load region only with pulverized coal from the start to the full load operation. Even in the coal burning boilers, readily ignitable auxiliary fuel such as light oil, heavy oil, gas and etc. other than pulverized coal is used for the start or low-load operation.

The reason for this is that, in the starting mode, it is impossible to obtain exhaust gas or heated air from the boiler for warming up a mill, and hence it is impossible to operate the mill for pulverizing coal.

Also, the light oil, heavy oil and gas are used for the reasons that it is impossible to keep a "turn down" ratio of the mill under the low load, and the ignition property of the pulverized coal itself is deteriorated.

For example, in the case where the light oil and heavy oil are used in the starting mode, the light oil is burned as fuel from the start to the 15% load, the fuel is switched over from the light oil to the heavy oil in the range of 15% load to 40% load, and over 40% load the mixture of the heavy oil and the pulverized coal is burned and over 40% load, the mixture is burned while gradually decreasing the amount of the heavy oil and gradually increasing the amount of the pulverized coal, thereby increasing the mixture burning rate of the pulverized coal for transferring to substantial coal burning.

On the other hand, in the case where the boiler load is reduced from full load to the low load, the pulverized coal fuel is burned to 35% load to operate the boiler as the coal burning boiler, and below the 35% load, the boiler is operated by auxiliary fuel such as heavy oil, light oil and gas.

As described above, in the coal burning thermal power plant which performs the DSS operational mode, it is normal to use the pulverized coal and the readily ignitable auxiliary fuel such as light oil, heavy oil and gas.

FIG. 4 is a schematic diagram showing a conventional pulverized coal burning boiler.

In FIG. 4, pulverized coal burners 4, 5, 6, 7, 8 and 9 are arranged from a bottom to a top of a boiler furnace 1 in a front wall 2 and a rear wall 3 of the boiler furnace 1.

After-air-ports 10 and 11 are provided above the pulverized coal burners 8 and 9 for reducing generation of NOx. Air is supplied from front wall wind boxes 12 and rear wall wind boxes 13 to the respective pulverized coal burners 4, 5, 6, 7, 8 and 9 and from a front wall wind box 14 and a rear wall wind box 15 to the after-air-ports 10 and 11, respectively.

The supply of coal to the pulverized coal burners 4, 5, 6, 7, 8 and 9 is performed as follows. Coal within a coal banker 16 is fed from a coal feeder 17 to a mill 18 and is pulverized within the mill 18. Rough particles contained in the pulverized coal in the mill 18 are classified by a classifier (not shown) and are returned back to the pulverizing section within the mill 18. The pulverized coal is fed from the pulverized coal supplying means, i.e., the mill 18 to the respective burners 4, 5, 6, 7, 8 and 9 by the delivery means including pulverized coal pipes 23, a blower 50 and the like. The delivery of the pulverized coal is performed by generating air flow from an air duct 22 through the mill 18 and the pulverized coal pipes 23 to the burners 4, 5, 6, 7, 8 and 9 by means of the blower 50.

The burning air for the front wall wind boxes 12, the rear wall wind boxes 13, the front wall wind box 14 and the rear wall wind box 15 is pressurized by a forced draft fan 19 and thereafter is preheated in an air heater 20. The air is supplied through an air passage 21, an air flow adjustment damper or restrictor 24 and air passage 25 to the wind boxes 12, 13, 14 and 15.

Gas is supplied to a hopper 26 by a gas recirculation fan 27 and a gas recirculation passage 28 for controlling a steam temperature during a partial load of the boiler. A gas duct 29 for mixing the gas with the burning air of an air passage 25 from an outlet of the gas recirculation fan 27 is provided for reducing the generation of the NOx.

The foregoing description relates to the general flows of the burning air, the gas and the pulverized coal in the pulverized coal boiler. It should be noted that the respective burners 4, 5, 6, 7, 8 and 9 are provided with igniters.

FIG. 5 is a enlarged view showing a detail of the fine coal burner shown in FIG. 4.

In FIG. 5, the reference numerals are used to show the same components as in FIG. 4. Reference numeral 1 denotes a boiler furnace, numeral 2 denotes a front wall, numeral 3 denotes a rear wall, numerals 4, 5, 6, 7, 8 and 9 denote pulverized coal burners, numerals 12 and 13 denote front and rear wall wind boxed, respectively, and reference numeral 23 denotes a pulverized coal pipe.

Reference numeral 30 denotes an air resistor and reference numeral 31 denotes a plasma igniter.

The development and research of a pilot burner wherein auxiliary fuel having good ignitability such as light oil, heavy oil, gas and the like for a pulverized coal boiler have been advanced. As a typical example, the development of the device provided with a plasma igniter 31 for directly igniting the pulverized coal using a plasma arc is realized as shown in FIG. 5. The igniter device provided with such a plasma igniter 31 is of the type such that a high temperature heat source at 1,500° to 2,000° C. is provided for directly igniting the pulverized coal without any auxiliary fuel such as light oil, heavy oil and gas. However, this system involves a serious problem and is not actually used since the ignition of the plasma arc needs a heat source near to 2,000° C. with large energy of 60 to 80 kW at the ignition stage, thereby discharging a great amount of thermal NOx at ignition with the pulverized coal burners 4, 5, 6, 7, 8 and 9.

In the conventional pulverized coal burning boiler, the light oil and heavy oil that have a good ignitability are used as auxiliary fuel, and in the load change mode due to the DSS operation, the heavy oil is used for the burner starting fuel and the light oil is used for the igniters in view of the ignitability and operability. Three different kinds of fuel including pulverized coal as the main fuel are needed for the conventional boiler. Thus, there is a disadvantage that the instrument cost and running cost in connection with the transportation, storage and maintenance of the respective fuels are required.

Also, in the direct ignition system using the plasma arc as described above, the ignition energy and the thermal source temperature are too high. Therefore, this system causes such a problem that a great amount of NOx is generated in the ignition operation.

In view of the foregoing defects inherent to the conventional system, an object of the invention is to provide a burner device for directly igniting the pulverized coal with high ignition reliability without discharging NOx larger than necessary and without auxiliary fuel.

Incidentally, Japanese Patent Unexamined Publication No. 61-184309 and U.S. Pat. No. 4,545,307 show the other prior art relating to the present invention.

SUMMARY OF THE INVENTION

According to the present invention, there is provided a pulverized coal igniting burner apparatus including a pulverized coal supplying source, a pulverized coal burner for igniting pulverized coal in the presence of oxygen, and a means to generate gas flow for delivering the pulverized coal from the pulverized coal supplying source to the pulverized coal burner, thereby supplying the pulverized coal burner with mixture of the pulverized coal and gas. The apparatus comprises an ignition region forming means for forming in the pulverized coal burner an ignition region in which a density of the pulverized coal of the mixture flow supplied to the pulverized coal burner by the delivery means is high and a flow rate of the mixture flow is low, and an igniting means for igniting the pulverized coal contained in the mixture flow within the ignition region.

DETAILED DESCRIPTION OF THE PRESENTLY PREFERRED EMBODIMENTS

Figure 1:
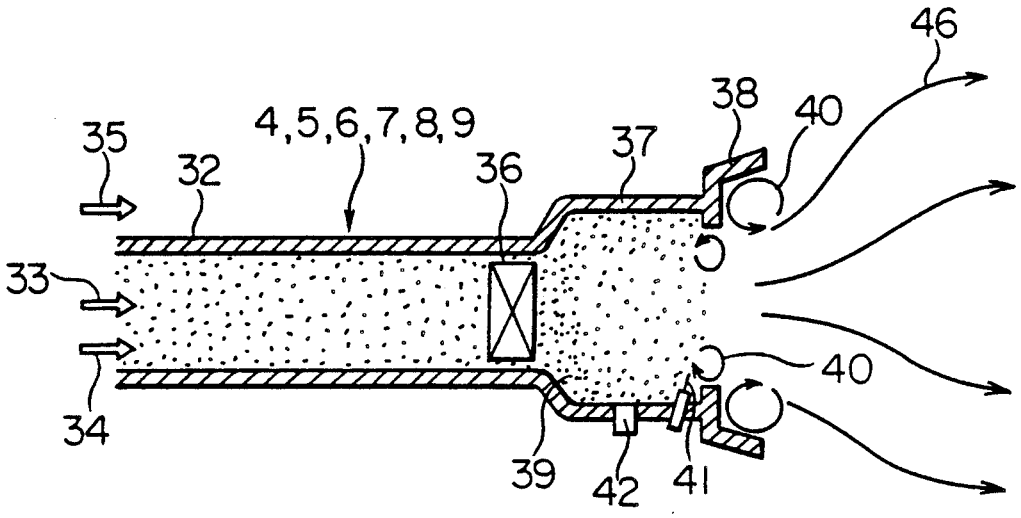
FIG. 1 is a cross-sectional view showing a primary part of a pulverized coal burner according to an embodiment of the invention.
Figure 2:
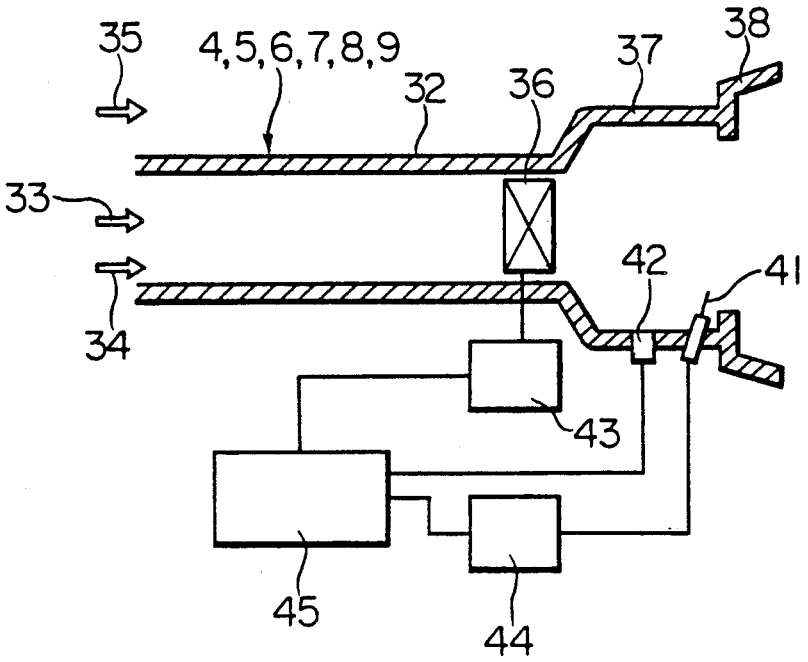
FIG. 2 is a view showing a structure of the burner shown in FIG. 1.
Figure 4:
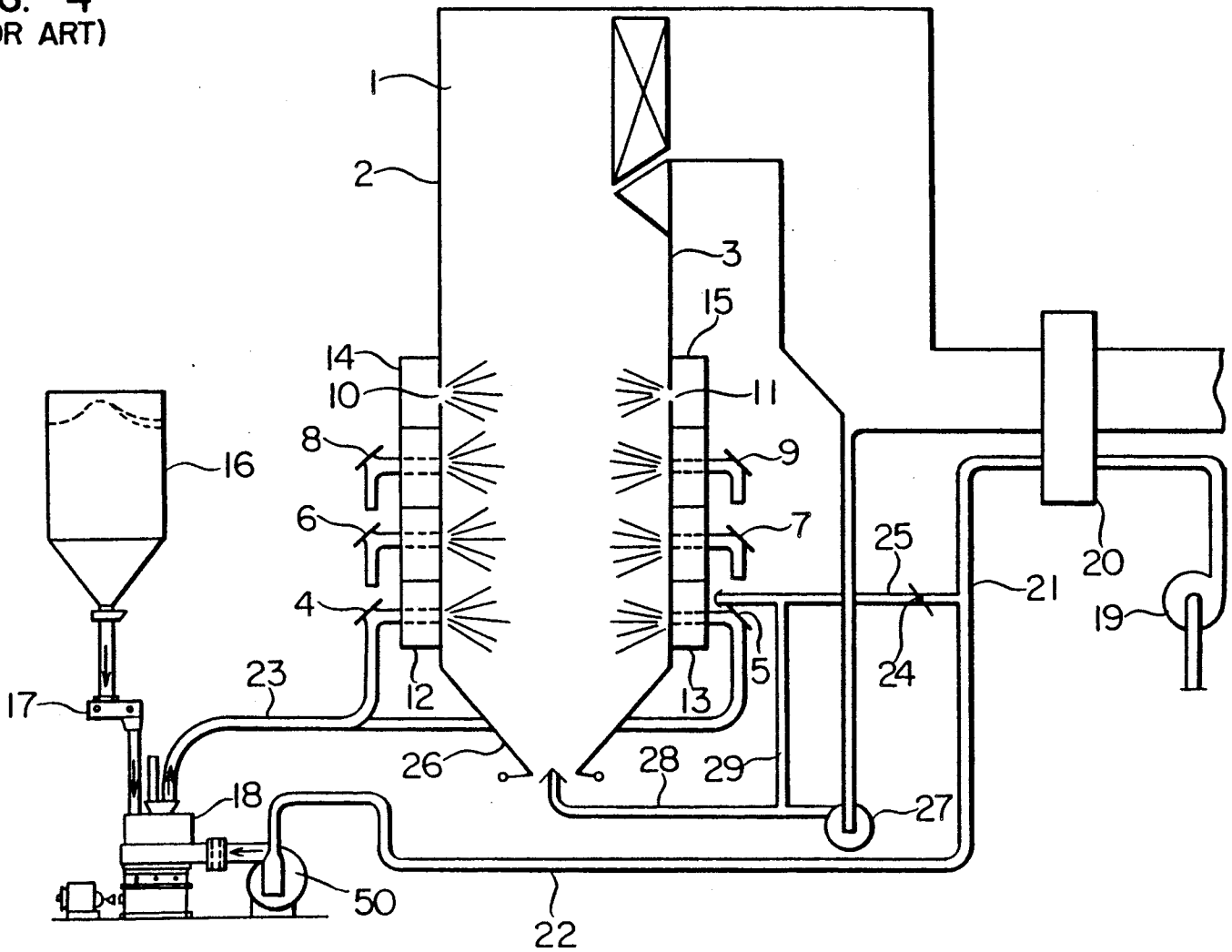
FIG. 4 (PRIOR ART)
FIG. 4 is a schematic view showing pulverized coal burning boiler system.
Figure 5:
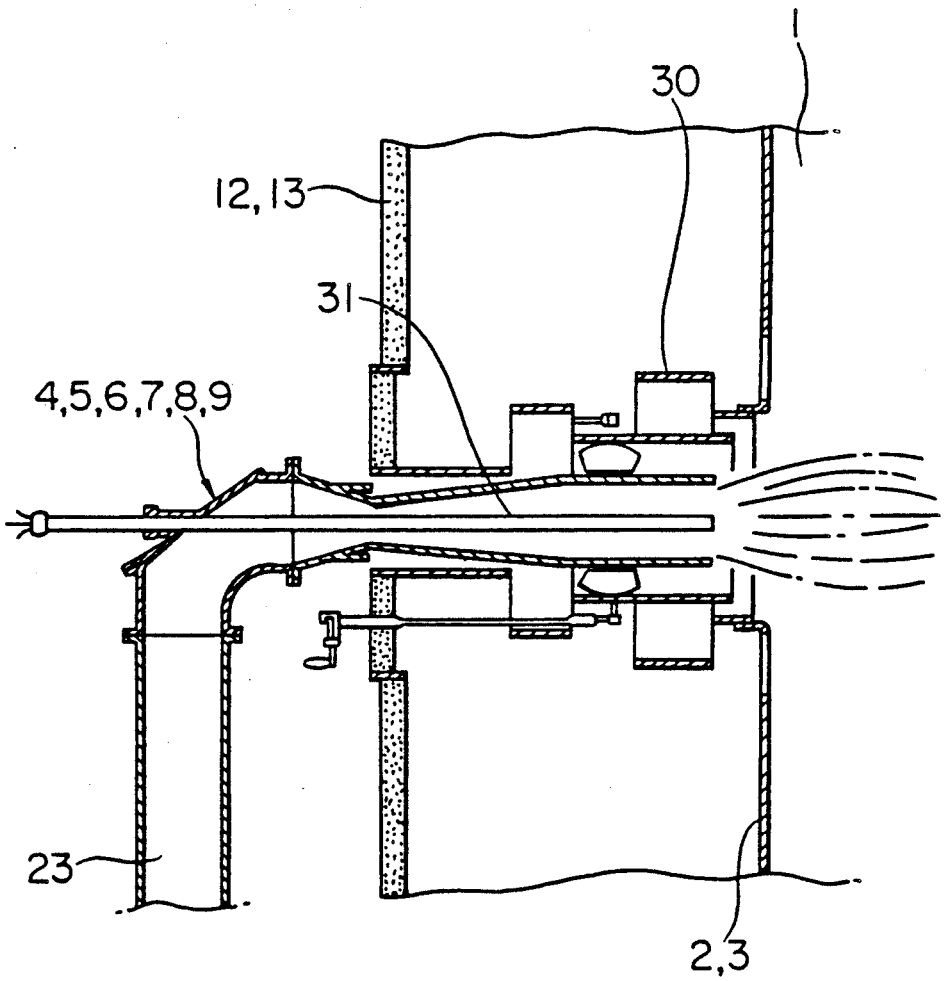
FIG. 5 (PRIOR ART)
FIG. 5 is a cross-sectional view showing a pulverized coal ignition burner provided with a plasma igniter.

In FIGS. 1 and 2, reference numerals 4, 5, 6, 7, 8 and 9 denote pulverized coal burners. A mixture flow of pulverized coal 33 and primary air 34 is supplied to a primary sleeve 32 from a mill 18 and a coal pipe 23 shown in FIG. 4. Secondary air 35 is supplied around a primary sleeve 32. These components are conventional.

Reference numeral 36 denotes a rotary vane for imparting a swirl motion to the mixture flow of the pulverized coal 33 and the primary air 34, numeral 37 denotes a large diameter portion formed at a distal end of the primary sleeve 32, numeral 38 denotes a flame maintaining means, numeral 39 denotes an ignition region, formed in the large diameter portion 37, in which the pulverized coal flow rate is slower than that within the primary sleeve 32, reference numeral 40 denotes an eddy circulation flow of the pulverized coal 33, and reference numeral 41 denotes a ceramic igniter. Reference numeral 42 denotes a C/A detector, reference numeral 43 denotes an opening adjuster for the rotary vane 36, numeral 44 denotes a heater electric source device for the ceramic igniter 41, numeral 45 denotes a controller and numeral 46 denotes flame.

The thus constructed pulverized coal ignition burner apparatus according to the embodiment includes, as shown in FIG. 2, the primary sleeve 32 for supplying the pulverized coal 33 and the primary air 34, the rotary vane 36 for imparting swirl motions to the mixture of the pulverized coal 33 and the primary air 34 to cause rich/ lean distribution in the mixture flow, the large diameter portion 37, the flame maintenance means 38, the opening adjuster 43 for adjusting the opening of the rotary vane 36, the C/A detector 42 for detecting the pulverized coal density (C/A), the ceramic igniter 41 for performing the ignition to the pulverized coal, the heater electric source device 44, and the controller 45 for controlling the opening of the rotary vane 36 in response to the signal outputted from the C/A detector 42 and for applying current/voltage to the heater 41 to impart the ignition command signal.

Figure 3:
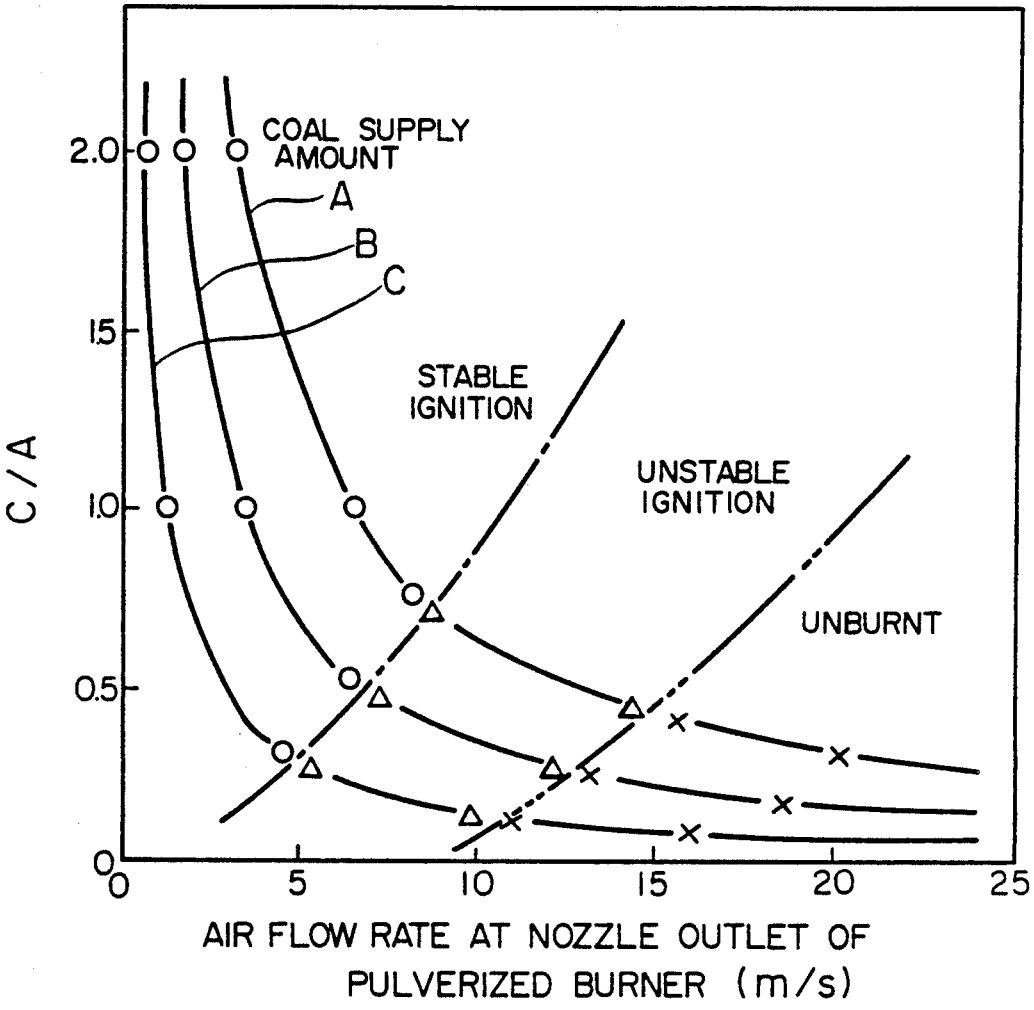
FIG. 3 is a graph showing an ignition characteristic curve of the ignition burner shown in FIG. 1 wherein a ratio of pulverized coal to air (C/A) is the ordinate and air flow rate (m/s) at a nozzle outlet of the burner is the abscissa.

FIG. 3 shows experimental results of the ignition characteristics in the case where the ceramic igniter 41 is inserted into the mixture flow. As is apparent from FIG. 3, it will be understood that, in order to stably ignite the mixture flow of the pulverized coal 33 and the primary air 34, the pulverized coal density (C/A) should meet the condition, $C/A \geqq$ approximately 0.5, and the air flow v should meet the condition, $v \leqq$ approximately 10 m/s. Also, FIG. 3 shows a requirement that the ignitability is liable to be affected by the flow rate as the amount of the pulverized coal is decreased from A to B and from B to C, and hence in order to perform the stable ignition, it is necessary to reduce the flow rate.

On the other hand, it is generally understood in view of the relationship of specific weight of the pulverized coal 33 or the like that the upper limit is defined by the value of the relationship, $C/A \leqq 0.5$. Also, the burner shape is designed so that the flow rate in the primary sleeve 32 is defined by the relationship of $v > 15$ m/s in view of the aspect of reducing the backfire.

Therefore, in order to directly ignite the pulverized coal 33 by using the heater such as ceramic igniter 41, it is necessary to modify the burner structure as proposed in accordance with the embodiment of the invention.

The effect of the ignition according to the embodiment will now be described with reference to FIGS. 1 and 2. The mixture flow of the pulverized coal 33 and the primary air 34 supplied at a flow rate of 15 to 20 m/s within the primary sleeve 32 is subjected to the swirl motion by the rotary vane 36 provided within the primary sleeve 32 and made of ceramics that are superior in heat resistance and wear resistance. As shown in FIG. 1, the ignition region 39 in which the pulverized coal density is high is formed within an inner surface of the large diameter portion of the primary sleeve 32.

It is necessary to set a suitable C/A according to the amount of the coal as shown in FIG. 3 in order to stably ignite the coal. According to the foregoing embodiment, the density of the pulverized coal within the large diameter portion 37 is detected by using the C/A detector 42 using a laser beam, and the opening of the rotary vane 36 is controlled in response to the detected signal by means of the opening adjuster 43 and the controller 45. If swirl motion would be excessively applied to the mixture by the rotary vane 36, the pressure loss would be significant. Therefore, it is possible to avoid the practical problem by controlling the opening of the rotary vane 36 so that the value of C/A is retained within a range of $0.5 \leqq C/A \leqq 2$.

There are air flow rate conditions as shown in FIG. 3 for other affecting parameters for stably igniting the coal. However, according to the embodiment, the flow rate is decreased from the range 15 to 20 m/s to 10 m/s or less by increasing diameters of the outlet ports of the pulverized coal burners 4, 5, 6, 7, 8 and 9, that is, by providing the large diameter portions 37 at the distal ends of the primary sleeve 32. Furthermore, as shown in FIG. 1, the mixture flow collides with the flame maintenance means 38 as shown in FIG. 1, so that the eddy recirculation flows 40 are formed in the vicinity of the flame maintenance means 38. The flow rate of the eddy recirculation flows 40 is in the low flow region of 0 to 5 m/s in terms of absolute values and is within the region where the ignition and flame maintenance are well performed. Namely, the ignition region 39 suitable for the direct ignition of the pulverized coal having a high pulverized coal density and at the low flow rate is formed at the inner surface of the outlet of each of the pulverized coal burners 4, 5, 6, 7, 8 and 9.

Subsequently, the particles of the pulverized coal 33 in the large diameter portion 37 collide with the ceramic igniter 41 heated at 1,000° to 1,200° C. set within the ignition region 39. As a result, a volatile component contained in the pulverized coal 33 is continuously ignited to form the flame 46 within the eddy recirculation flows 40.

As described above, according to the embodiment of the invention, it is possible to directly ignite the pulverized coal in a positive and stable manner without generation of the thermal NOx unlike the conventional plasma igniter.

Although the pulverized coal density is increased by the rotary vane 36 in accordance with the embodiment of the invention, the invention is not limited to the embodiment shown. It is possible to enhance the pulverized coal density by supplying the pulverized coal from another bottle laid on another place to the interior of the primary sleeve 32. Also, it is possible to increase the pulverized coal density within the primary sleeve 32 by extracting the primary air 34 from the primary sleeve 32.

INDUSTRIAL APPLICABILITY

According to the present invention, since the pulverized coal is directly ignited, it is unnecessary to use the auxiliary fuel such as light oil, heavy oil and gas, and in addition, to reduce the thermal NOx generation at the ignition operation. Also, if the pulverized coal directly igniting burner according to the invention is applied to the pulverized coal burning boiler, it is possible to sum up three systems for the light oil, heavy oil and pulverized coal into a single system for the pulverized coal, so that maintenance for additional instruments and additional fuel supply may be dispensed with.

We claim:

1. A pulverized coal igniting burner apparatus including a pulverized coal supplying source, a pulverized coal burner for igniting pulverized coal in the presence of oxygen, said pulverized coal burner including a primary sleeve and an ignition region, delivery means for generating a flow of primary air and delivering the pulverized coal from said pulverized coal supplying source to said ignition region through said primary sleeve, thereby supplying the ignition region with mixture of the pulverized coal and the primary air at a flow rate, and igniting means for igniting the pulverized coal contained in the mixture within said ignition region, wherein said primary sleeve has an outer periphery along which secondary air flows and a distal end formed with a large diameter portion for reducing the flow rate of the mixture, said igniting means being located adjacent the inner peripheral wall of the large diameter portion such that a vicinity of an inner peripheral portion within said large diameter portion not exposed to said secondary air constitutes said ignition region; and a rotary vane is provided in said primary sleeve adjacent said large diameter portion for imparting swirling energy to the mixture thereby to enhance density of the pulverized coal contained in the mixture introduced into said ignition region, and further comprising flame maintenance means for maintaining a flame at an outer peripheral portion of said large diameter portion, said flame maintenance means protruding inwardly from the inner peripheral portion of the large diameter portion so that eddy recirculation flows of the mixture are formed in the vicinity of the flame maintenance means.

2. A pulverized coal igniting burner apparatus including a pulverized coal supplying source, a pulverized coal burner for igniting pulverized coal in the presence of oxygen, said pulverized coal burner including a primary sleeve and an ignition region, delivery means for generating a flow of primary air and delivering the pulverized coal from said pulverized coal supplying source to said ignition region through said primary sleeve, thereby supplying the ignition region with mixture of the pulverized coal and the primary air at a flow rate, and igniting means for igniting the pulverized coal contained in the mixture within said ignition region, wherein said primary sleeve has an outer periphery along which secondary air flows and a distal end formed with a large diameter portion for reducing the flow rate of the mixture, a vicinity of an inner peripheral portion within said large diameter portion not exposed to said secondary air constitutes said ignition region; and a rotary vane is provided in said primary sleeve adjacent said large diameter portion for imparting swirling energy to the mixture thereby to enhance density of the pulverized coal contained in the mixture introduced into said ignition region and, further comprising means for detecting density of the pulverized coal within said ignition region, and means for controlling opening of said rotary vane in response to a signal outputted from said detecting means.

3. The pulverized coal igniting burner apparatus as claimed in claim 1, further comprising means for detecting density of the pulverized coal within said ignition region, and means for controlling opening of said rotary vane in response to a signal outputted from said detecting means.

* * * * *